US006030231A

United States Patent [19]

Särkiniemi

[11] Patent Number: 6,030,231

[45] **Date of Patent: *Feb. 29, 2000**

[54] COAXIAL CONNECTOR CONNECTED TO A CIRCUIT BOARD

[75] Inventor: Mauno Särkiniemi, Oulu, Finland

[73] Assignee: Nokia Telecommunications Oy, Espoo, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/836,941

[22] PCT Filed: Sep. 13, 1996

[86] PCT No.: PCT/FI96/00485

§ 371 Date: May 13, 1997

§ 102(e) Date: May 13, 1997

[87] PCT Pub. No.: WO97/10629

PCT Pub. Date: Mar. 20, 1997

[30] Foreign Application Priority Data

Sep. 14, 1995 [FI] Finland ..... 954332

[51] Int. Cl.[7] ..... H01R 9/09

[52] U.S. Cl. ..... 439/63; 439/101

[58] Field of Search ..... 439/63, 581, 79, 439/101

[56] References Cited

U.S. PATENT DOCUMENTS

| | | | |
|---|---|---|---|
| 4,451,107 | 5/1984 | Dola et al. | 439/79 |
| 4,737,111 | 4/1988 | Minar et al. | 439/63 |
| 4,975,066 | 12/1990 | Sucheski et al. | 439/63 |
| 5,076,804 | 12/1991 | Bertho et al. | 439/567 |
| 5,197,893 | 3/1993 | Marlion et al. | 439/101 |
| 5,462,444 | 10/1995 | Korsunsky et al. | 439/108 |
| 5,595,499 | 1/1997 | Zander et al. | 439/352 |

FOREIGN PATENT DOCUMENTS 446 980 9/1991 European Pat. Off. .

*Primary Examiner*—Steven L. Stephan
*Assistant Examiner*—T. C. Patel
*Attorney, Agent, or Firm*—Pillsbury Madison & Sutro LLP

[57] ABSTRACT

A coaxial connector for mounting on a circuit board that includes an elongated bar-like center connector whose first end is formed to receive a center connector in a counterpart coaxial connector, and whose second end is provided with an attachment pin to connect the center connector to a conductor tab on the circuit board surface, whereby the attachment pin will be positioned substantially parallel to the conductor tab, and a pipe-like connector whose first end is formed to surround the center connector in order to receive a pipe-like connector in the counterpart coaxial connector, and whose second end is provided with a grounding pin for connecting the pipe-like connector to a grounding tab on the circuit board surface. In this context, a "bar-like center connector" refers to a straight, elongated connector which may be hollow or solid depending on whether the coaxial connector is male or female.

2 Claims, 1 Drawing Sheet

COAXIAL CONNECTOR CONNECTED TO A CIRCUIT BOARD

BACKGROUND OF THE INVENTION

This application is the national phase of international application PCT/F196/00485 filed Sep. 13, 1996 which designated the U.S.

FIELD OF THE INVENTION

This invention pertains to the field of coaxial connectors and to a method of fixing a coaxial connector to a circuit board.

The prior art discloses a rectangular coaxial connector which can be fixed to a circuit board surface by separate fixing means, such as fixing screws. This results in contact being established between the center conductor of the coaxial connector and the conductor tab on the circuit board. In a corresponding manner, contact is also established between the pipe-like connector of the coaxial connector and the grounding tab on the circuit board.

The most serious drawback of the angle connector described above is that its center connector and the conductor tab on the circuit board will be positioned on different levels when the angular connector is fixed to the circuit board. Consequently, the connecting piece that connects the center connector and the conductor tab a form a right angle with both the center connector and the conductor tab. A right angle, however, causes the electrical properties of the coaxial connector to deteriorate due to reflections that it creates. In addition, the angle connector is relatively high, which causes problems especially if the circuit board has to be installed in a narrow space. Furthermore, fixing the angle connector with screws is relatively laborious and slow.

The prior art additionally discloses a coaxial connector for mounting on a circuit board edge, in which the center conductor of the coaxial connector extends through the connector housing as an unbroken bar, thus constituting a pin which provides an extension for the conductor tab on the circuit board when the connector is fixed to the circuit board, whereby the best possible electrical properties can be achieved. However, this prior art connector has the drawback of being difficult to fix: it is also fixed to the circuit board with separate fixing means, i.e. fixing screws or similar, which makes the fixing process rather difficult, and, additionally, increases the number of parts in the connector.

SUMMARY OF THE INVENTION

It is an object of the present invention to solve the aforementioned drawback and to provide a method for fixing a coaxial connector to a circuit board in a simpler and faster manner than before. This object is achieved by a method of the invention, characterized by the steps of fixing the coaxial connector to the circuit board without using separate fixing means by inserting a grounding pin, which is arranged in the coaxial connector and which extends from the coaxial connector at a substantially right angle in relation to the attachment pin, into a hole or recess on the circuit board, the diameter of said hole or recess substantially corresponding to the grounding pin diameter; and soldering the attachment pin of the coaxial cable to the conductor tab.

The invention further relates to a coaxial connector by means of which the method according to the invention can be implemented. The coaxial connector, according to the invention, is characterized in that the grounding pin is arranged to protrude from the coaxial connector in such a direction that the grounding pin and the attachment pin together form a substantially right angle, thus making the grounding pin protrude into a hole or recess in the surface of the circuit board when the coaxial connector is arranged in place on the circuit board.

The expression 'a substantially right angle' in this context means that the angle between the conductor pin, parallel to the surface of the circuit board, and the grounding pin is such that the grounding pin protrudes through the hole or recess on the circuit board at an angle at which the coaxial connector is prevented from moving in the direction of the surface of the circuit board in relation the circuit board surface for as long as the grounding pin is within the hole or recess.

The invention is based on the idea that if the grounding pin of the connector is so designed that it can be utilized in fixing the connector either by soldering the grounding pin to the grounding tab on the circuit board, or so that it can be inserted into the hole or recess on the circuit board, and when the attachment pin of the coaxial connector is thereafter soldered to the conductor tab on the circuit board the coaxial connector will be secured so rigidly on the circuit board that fixing it by means of fixing screws or similar fixing means will not be required. Fixing the coaxial connector thus becomes considerably easier and faster as a result of the fixing no longer requiring the use of separate fixing means, such as fixing screws, and therefore one stage, i.e fixing, can be dropped. Consequently, the structure of the connector also becomes simpler, reducing its price. By means of the invention, a most economical connector can be provided, having a flat design, the best possible electrical properties, and a straightforward means of handling and fixing.

According to an embodiment of the connector, according to the invention, the grounding pin (or pins) of the coaxial connector is (are) of press-fit type, whereby the grounding pin is so designed that it is attached to the circuit board by means of friction. Alternatively, the grounding pin may be provided with lugs or similar fixing means, by which the grounding pin is attached by shape to the circuit board. Consequently, the coaxial connector is attached securely to the circuit board already at the mounting stage. This makes it possible to move the circuit board from one place to another or, for example, keep it in an intermediate storage before the coaxial connector is finally fixed to the circuit board by soldering its attachment pin to the conductor tab on the circuit board. This embodiment of the invention is particularly cost-effective in case the circuit board assembly is automatized e.g. with a robot carrying out the soldering. In such as case, it is of utmost importance that the coaxial connector can actually be mounted in the proper place before the soldering stage and that the connector not move during soldering.

The preferred embodiments of the method and coaxial connector according to the invention are disclosed in the attached dependent claims 2–3 and 5–7.

BRIEF DESCRIPTION OF THE DRAWINGS

In the following, the invention will be described in more detail by means of preferred embodiments of the coaxial connector according to the invention, with reference to the accompanying drawings, in which.

DETAILED DESCRIPTION OF THE PREFERRED EMBODIMENTS

Figure 1:
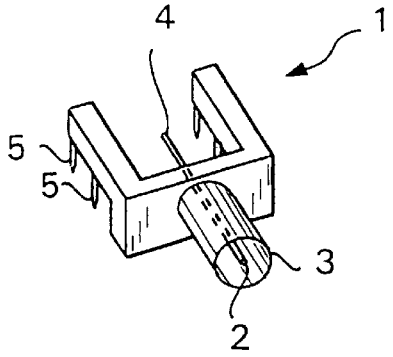
FIG. 1 illustrates a first preferred embodiment of the coaxial connector according to the invention.

FIG. 1 illustrates a first preferred embodiment is of the coaxial connector 1 according to the invention. The connector of FIG. 1 comprises a bar-like center connector 2 whose first end is formed to receive a center connector in a counterpart of the coaxial connector (i.e a second coaxial connector), and whose second end is formed with an attachment pin 4.

The center connector 2 is surrounded by a pipe-like connector 3 which is, through the housing of the connector 1, connected to grounding pins 5 of which there may be one or more. At least one of the grounding pins 5 is arranged to protrude from the coaxial connector at such an angle that is forms a 90° angle with the attachment pin 4.

Figure 2:
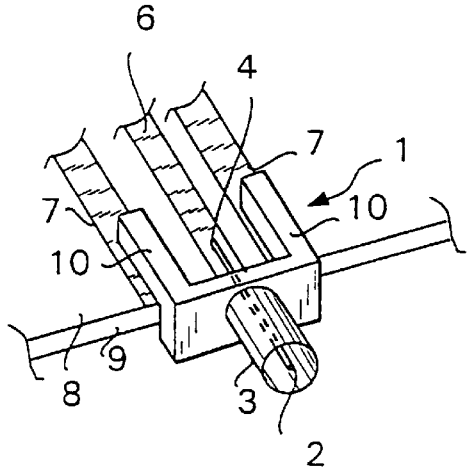
FIG. 2 shows the coaxial connector of FIG. 1 fixed to a circuit board.

FIG. 2 shows the coaxial connector of FIG. 1 fixed to a circuit board 8. As is apparent from FIG. 2, the attachment pin 4 is positioned on a conductor tab 6 on the circuit board upon mounting the connector in place at an edge 9 of the circuit board 8. At the same time, the projections 10 extending from the housing of the coaxial connector are also positioned against the circuit board surface. The projections may be made of e.g plastic or any similar dielectric material.

The grounding pins 5 cannot be seen in FIG. 2, because they have been inserted into the holes or recesses provided in the circuit board surface, whereby the grounding pins 5 and the grounding tabs 7 on the circuit board surface are brought into contact. In addition, the grounding pins can, if required, be soldered to the grounding tabs. If the grounding pins are of press-fit type, they have been dimensioned and formed so that frictional force keeps them in the holes or recesses on the circuit board. Hence, the coaxial connector 1 is firmly secured at the circuit board edge 9 immediately upon inserting its grounding pins into the holes or recesses on the circuit board 8, which makes soldering of the grounding pins to the grounding tabs unnecessary.

As the coaxial connector has been mounted, as illustrated by FIG. 2, it is fixed to the circuit board by soldering its attachment pin 4 to the conductor tab 6 on the circuit board. Thus, the coaxial connector is fixed to the circuit board by means of the grounding pins and soldering, making separate attaching parts unnecessary for fixing.

Figure 3A:
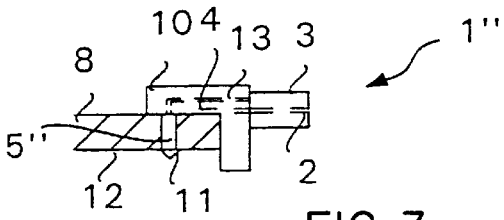
FIGS. 3*a* and 3*b* illustrate a second preferred embodiment of the coaxial connector according to the invention.
Figure 3B:
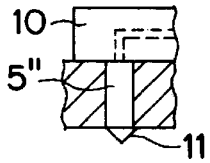

FIGS. 3*a* and 3*b* illustrate a second preferred embodiment of the coaxial connector 1" according to the invention, in which the grounding pin of the coaxial connector is provided with lugs to achieve a shape-based attachment between the grounding pin and the circuit board.

FIG. 3*a* is a side view of a coaxial connector 1" fixed to the circuit board 8, thus showing the circuit board 8 in cross section. The connector 1" of FIG. 3 otherwise entirely corresponds with the coaxial connector 1 shown by FIGS. 1 and 2 but only has one grounding pin 5" which in addition is provided with a lug 11.

As is apparent from FIG. 3*a,* the grounding pin 5" is so dimensioned that its length is greater than the thickness of the circuit board 8. Consequently, the grounding pin end that is provided with the lug protrudes under the circuit board so that the lug 11 makes contact with the lower surface 12 of the circuit board. Therefore, the grounding pin 5" and the entire coaxial connector 1" are already, at this stage, attached relatively firmly to the circuit board. FIG. 3*b* shows an enlarged view of the lug 11 in protruding from the circuit board and containing the lower surface of the circuit board.

The broken lines in FIG. 3*a* illustrate a conductor 13 extending through the connector 1" housing, the conductor 13 connecting the pine-like connector 3 of the coaxial connector to the grounding pin 5". The pipe-like connector 3 is consequently grounded upon inserting the grounding pin 5" into the hole in the circuit board so that contact is established between the pin and the grounding tab on the upper surface (or the lower surface) of the circuit board.

Figure 4:
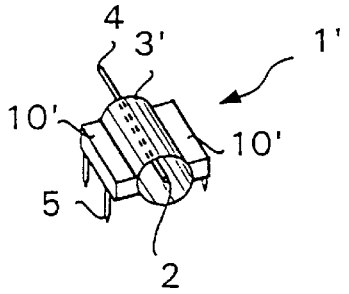
FIG. 4 illustrates a third preferred embodiment of the coaxial connector according to the invention.

FIG. 4 illustrates a third preferred embodiment of the coaxial connector 1' according to the invention. The connector 1' of FIG. 4 comprises two flat elongated projections 10' which are attached to a pipe-like connector 3'. From the projections 10', grounding pins protrude so that they and the attachment pin 4, constituting an extension for the center connector 2 of the connector 1', together form a substantially 90° angle.

Figure 5:
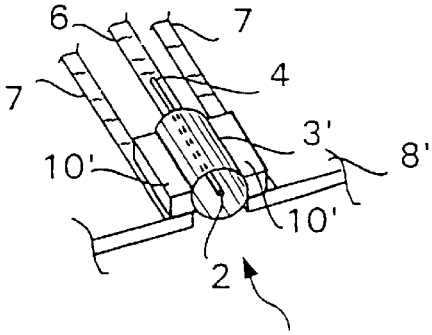
FIG. 5 shows the coaxial connector of FIG. 4 fixed to a circuit board.

FIG. 5 shows the coaxial connector of FIG. 4 fixed to a circuit board 8'. As shown by FIG. 5, there is a hole arranged in the circuit board 8' for the coaxial connector, whereby the depth of the hole substantially corresponds to the length of the pipe-like connector 3' and the width to its diameter. Hence, the pipe-like connector 3' is partly embedded in the circuit board hole so that the projections 10' are mounted against the surface of the circuit board 8' while the attachment in 4' is mounted against the conductor tab 6 on the surface of the circuit board.

The coaxial connector according to FIG. 5 is fixed to the circuit board in a similar manner as disclosed in connection with the previous Figures, i.e. its grounding pins 5 penetrate into the holes or recesses on the circuit board surface at the same time as contact is established between them and the grounding tabs 7. Then, the coaxial connector 1' is finally fixed by soldering its pin to the conductor tab 6 on the circuit board 8'.

Figure 6:
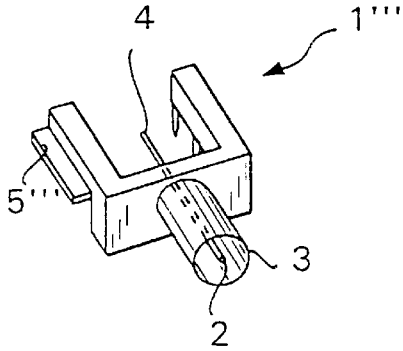
FIG. 6 illustrates a fourth preferred embodiment of the coaxial connector according to the invention.

FIG. 6 illustrates a fourth preferred embodiment of the coaxial connector according to the invention. The coaxial connector 1'" illustrated by FIG. 6 differs from the embodiments described above in having its grounding pin 5'" arranged to protrude sideways from the projection 10 of the connector. Consequently, the grounding pin is not placed in the hole or recess provided on the circuit board as in the previous embodiments but it is positioned against the grounding conductor on the surface of the circuit board in a similar manner as the attachment pin 4 is positioned against the conductor tab on the circuit board surface.

After this, the fixing of the coaxial connector 1'" to the circuit board takes place by soldering the grounding pin 5'" and pin 4 to the circuit board, whereby fixing the connector 1'" requires no separate parts.

It should be noted that the description and the figures relating thereto are only intended to illustrate the present invention. Different kinds of variations will be obvious for persons skilled in the art, without departing from the scope of the invention.

I claim:

1. A coaxial connector, comprising:

an elongated center connector having a first end formed to receive a center connector in a counterpart coaxial connector, and having a second end formed as an attachment pin arranged to connect the center connector to a conductor tab on a surface of the circuit board, such that the attachment pin is positioned substantially parallel to the conductor tab when the coaxial connector is mounted on the circuit board;

an outer connector having a first end formed to surround the center connector and receive another outer connector in the counterpart coaxial connector;

a grounding pin for connecting the outer connector to a grounding tab on the surface of the circuit board, wherein the grounding pin is provided with a lug and arranged to protrude in such a direction that the grounding in and the attachment pin together form a substantially right angle, whereby the grounding pin protrudes into a hole or recess formed in the surface of the circuit board when the coaxial connector is mounted on the circuit board, and the lug locks the grounding pin to the hole or the recess formed in the surface of the circuit board;

a housing including a first surface from which the center connector and the outer connector protrude;

a second surface, which is positioned against an edge of the circuit board, when the coaxial connector is mounted on the circuit board, and from which the attachment pin protrudes; and a plurality of projections which are positioned against a top surface of the circuit board when the coaxial connector is mounted on the circuit board, whereby the grounding pin protrudes from one of the projections.

2. A coaxial connector, comprising:

an elongated center connector having a first end formed to receive a center connector in a counterpart coaxial connector, and having a second end formed as an attachment pin arranged to connect the center connector to a conductor tab on a surface of the circuit board, such that the attachment pin is positioned substantially parallel to the conductor tab when the coaxial connector is mounted on the circuit board;

an outer connector having a first end formed to surround the center connector and receive another outer connector in the counterpart coaxial connector; and a grounding pin for connecting the outer connector to a grounding tab on the surface of the circuit board, wherein the grounding pin is provided with a lug and arranged to protrude in such a direction that the grounding pin and the attachment pin together form a substantially right angle, whereby the grounding pin protrudes into a hole or recess formed in the surface of the circuit board when the coaxial connector is mounted on the circuit board, and the lug locks the grounding pin to the hole or the recess formed in the surface of the circuit board, and wherein the outer connector is provided with a plurality of flat projections, which protrude in opposite directions from an outer surface of the outer connector, the grounding pin protruding from one of the projections.

* * * * *